US010019937B2

(12) United States Patent
Yoo et al.

(10) Patent No.: US 10,019,937 B2
(45) Date of Patent: Jul. 10, 2018

(54) FLEXIBLE DISPLAY DEVICE

(71) Applicant: SAMSUNG DISPLAY CO., LTD., Yongin-si, Gyeonggi-do (KR)

(72) Inventors: Young Wook Yoo, Suwon-si (KR); Naoaki Komiya, Suwon-si (KR)

(73) Assignee: Samsung Display Co., Ltd., Yongin-si, Gyeonggi-do (KR)

( * ) Notice: Subject to any disclaimer, the term of this patent is extended or adjusted under 35 U.S.C. 154(b) by 40 days.

(21) Appl. No.: 15/016,833

(22) Filed: Feb. 5, 2016

(65) Prior Publication Data

US 2016/0351127 A1 Dec. 1, 2016

(30) Foreign Application Priority Data

Jun. 1, 2015 (KR) ..... 10-2015-0077217

(51) Int. Cl.
*G09G 3/32* (2016.01)
*G09G 3/3208* (2016.01)

(52) U.S. Cl.
CPC ..... *G09G 3/3208* (2013.01); *G09G 2360/14* (2013.01); *G09G 2360/145* (2013.01); *G09G 2380/02* (2013.01)

(58) Field of Classification Search
CPC ..... G09G 3/3208; G09G 2360/145; G09G 2360/14; G09G 2380/02
See application file for complete search history.

(56) References Cited

U.S. PATENT DOCUMENTS

2012/0115422 A1* 5/2012 Tziortzis ..... G06F 3/01 455/73
2013/0201115 A1* 8/2013 Heubel ..... G06F 3/0487 345/173
2015/0364496 A1* 12/2015 Kaneyasu ..... G06F 3/042 257/43
2016/0070305 A1* 3/2016 Kim ..... G06F 1/1652 345/173

FOREIGN PATENT DOCUMENTS

| | | | |
|---|---|---|---|
| JP | 2007-016243 | A | 1/2007 |
| JP | 2012-142001 | A | 7/2012 |
| JP | 2014-029698 | A | 2/2014 |
| KR | 10-2005-0056395 | A | 6/2005 |
| KR | 10-2011-0070608 | A | 6/2011 |
| KR | 10-2013-0006757 | A | 1/2013 |
| KR | 10-2014-0069329 | A | 6/2014 |

* cited by examiner

*Primary Examiner* — Patrick Edouard
*Assistant Examiner* — Maheen Javed
(74) *Attorney, Agent, or Firm* — Lee & Morse, P.C.

(57) ABSTRACT

A flexible display device includes a sensing line, a sensor, and a signal controller. The sensor generates a sensing signal corresponding to a quantity of light of the sensing line. The signal controller detects an intersection of the sensing line and the sensor and generates a control signal corresponding to movement of the intersection.

15 Claims, 9 Drawing Sheets

FLEXIBLE DISPLAY DEVICE

CROSS-REFERENCE TO RELATED APPLICATION

Korean Patent Application No. 10-2015-0077217, filed on Jun. 1, 2015, and entitled, "Display Device," is incorporated by reference herein in its entirety.

BACKGROUND

1. Field

One or more embodiments described herein relate to a display device.

2. Description of the Related Art

An organic light emitting diode display generates high quality, high luminance images with low power and high reaction speed. This type of display is also thinner and lighter in weight than other displays, mainly because a separate light source is not required. However, the substrate of an organic light emitting diode display is made of glass and thus is not flexible.

SUMMARY

In accordance with one or more embodiments, a display device includes a flexible display including a sensing line; a sensor to generate a sensing signal corresponding to a quantity of light of the sensing line; and a signal controller to detect an intersection of the sensing line and the sensor and to generate a control signal corresponding to movement of the intersection. The signal controller may generate a first control signal based on movement of the intersection in a first direction. The signal controller may generate a second control signal based on movement of the intersection in a second direction opposite to the first direction. The signal controller may generate a third control signal based on reciprocal movement of the intersection in the first and second directions at least one time. The signal controller may generate a fourth control signal based on reciprocal movement of the intersection in the first and second directions at least two times.

The sensor may include a plurality of photo-transistors, and the signal controller may detect the intersection of the sensing line and at least one of the photo-transistors while the display is folded in a first direction. The display device may include a data driver to generate a photo-sensor control signal; a plurality of switches; and a switch driver to control the switches, wherein each of the photo-transistors includes a first electrode to receive a driving voltage, a second electrode connected to a first electrode of one of the switches, and a gate electrode to receive the photo-sensor control signal.

Each of the switches may include a first electrode connected to a second electrode of one of the photo-transistors, a second electrode connected to a sensing signal line, and a gate electrode connected to one of a plurality of switch driving lines, each of the switches may be turned on by a switch driving signal applied from the switch driving line.

The switch driver may sequentially apply the switch driving signal to the switches, and the switch driver may sequentially apply a switch driving signal to a gate electrode of each of the switches, the signal controller may detect the intersection based on the sensing signal and a switch driving time when the switch driving signal is applied.

The display may display the sensing line; the sensor may generate a first sensing signal of a first level at a time point other than a predetermined time point, the sensor may generate a second sensing signal of a second level lower than the first level at the predetermined point, and the signal controller may recognize that the sensing signal is generated from the sensing line when the second sensing signal of the second level is generated at the predetermined time point.

In accordance with one or more other embodiments, an apparatus includes a flexible display to display a line; a sensor to generate a first signal when light is detected from the line; and logic to generate a second signal based on the first signal, wherein the sensor is to generate the first signal when the flexible display is folded to cause the line to intersect the sensor. The line may be adjacent a first side of the display, and the sensor may be adjacent a first side of the flexible display. The first and second sides may be opposing sides of the flexible display.

The logic may generate a first control signal based on movement of the intersection. The first control signal may correspond to a call function. The logic may generate a first control signal based on movement of the intersection in a first direction. The logic may generate a second control signal based on movement of the intersection in a second direction opposite to the first direction.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
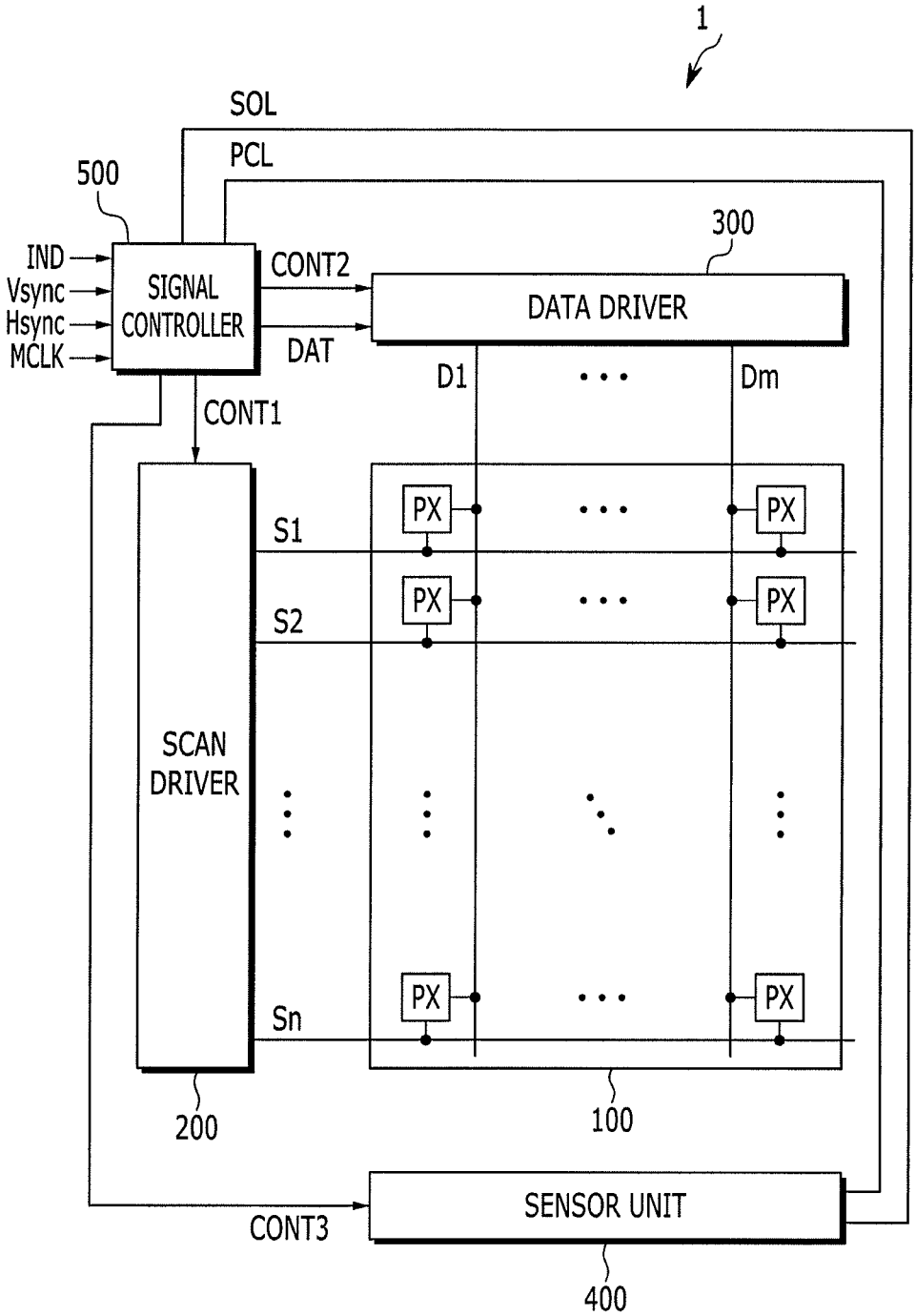
FIG. 1 illustrates an embodiment of a display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments.

It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

It is to be understood that when one component is referred to as being "connected" or "coupled" to another component, it may be connected or coupled directly to the other component or be connected or coupled to the other component with a further component intervening therebetween. On the other hand, it is to be understood that when one component is referred to as being "connected or coupled directly" to another component, it may be connected to or coupled to the other component without another component intervening therebetween.

FIG. 1 illustrates an embodiment of a display device 1 which includes a plurality of scanning lines S1-Sn, a plurality of data lines D1-Dm, a display unit 100, a scan driver 200, a data driver 300, a sensor unit 400, and a signal controller 500. The scanning lines S1-Sn may be arranged in a first (e.g., vertical) direction, and each of the scanning lines S1-Sn may extend in a second (e.g., horizontal) direction. The data lines D1-Dm are arranged in the second direction and the data lines D1-Dm extend in the first direction.

The display unit 100 is a flexible display panel which includes a plurality of pixels PX arranged substantially in the form of a matrix. Each pixel PX is connected to a corresponding one of the scanning lines S1-Sn and a corresponding one of the data lines D1-Dm. The display unit 100 may display a sensing line SL (see, e.g., FIG. 4).

The scan driver 200 supplies a plurality of scanning signals to corresponding scanning lines S1-Sn according to scan control signals CONT1.

The data driver 300 generates a plurality of data signals (e.g., data voltages) based on image data DAT input according to data driving control signals CONT2. The data signals are transferred to the data lines D1-Dm, respectively.

The sensor unit 400 is connected to the signal controller 500 through a sensing signal line SOL. The sensor unit 400 includes a photo-transistor unit 410 (see, e.g., FIG. 2) which operates according to a photo-sensor control signal and generates sensing signals according to switch control signals CONT3.

The signal controller 500 generates various control signals CONT1, CONT2, and CONT3 based on signals supplied, for example, from an external source. The signals from the external source include, for example, one or more vertical synchronization signals Vsync, horizontal synchronizing signals Hsync, clock signals MCLK, or image signals IND.

The signal controller 500 may be connected to the sensor unit 400 through a photo-sensor control line PCL and a sensing signal line SOL. The signal controller 500 may apply a photo-sensor control signal to the photo-sensor control line PCL. Also, the signal controller 500 generates a UI control signal to correspond to movement of an intersection using a sensing signal SO. Image data of the sensing line SL (see, e.g., FIG. 3) may be included in image data DAT.

Figure 2:
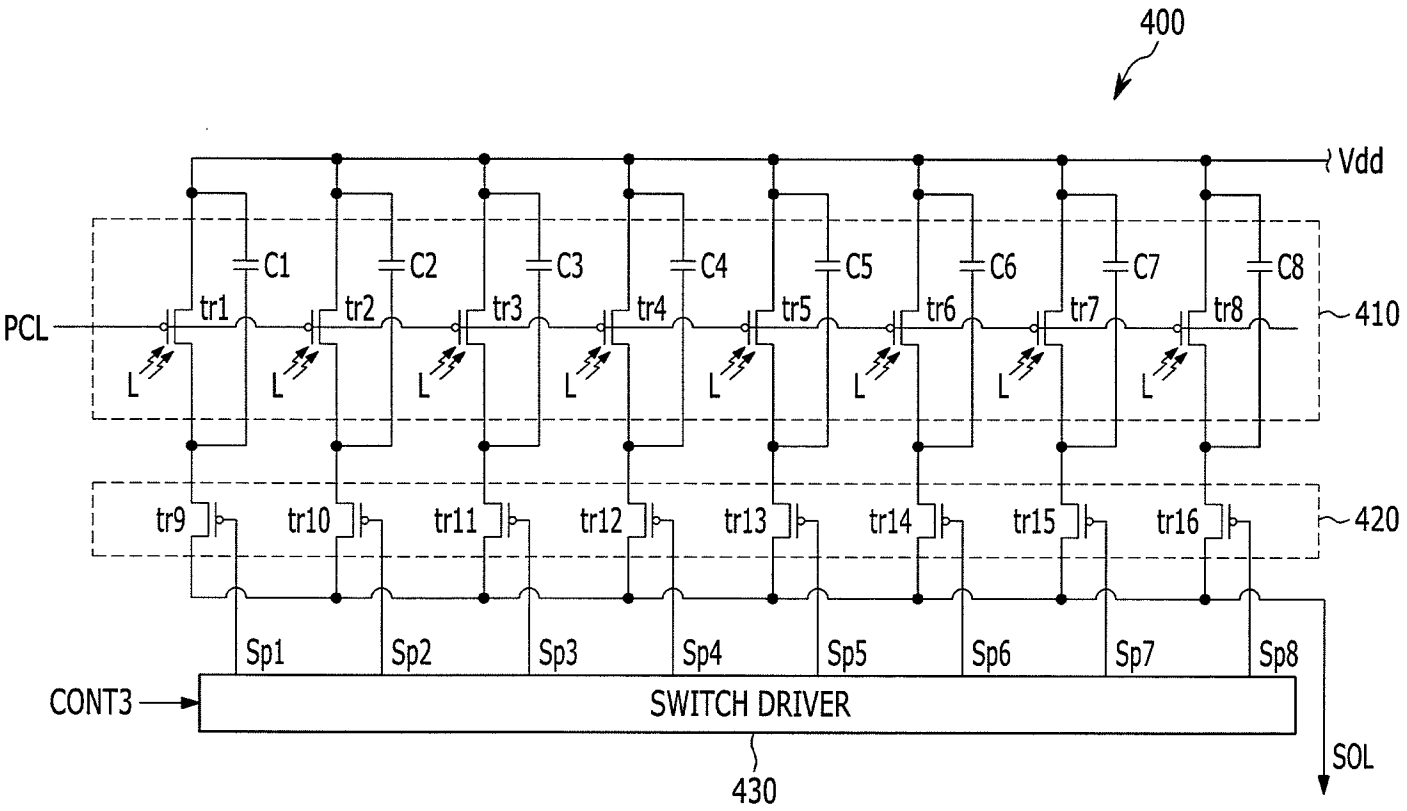
FIG. 2 illustrates an embodiment of a sensor.

FIG. 2 illustrates an embodiment of the sensor unit 400, which includes a photo-transistor unit 410, a switch unit 420, and a switch driver 430. The photo-transistor unit 410 includes a plurality of photo-transistors tr1-tr8 and a plurality of capacitors C1-C8, where each of the photo-transistors tr1-tr8 includes a first electrode to which a photo-transistor driving voltage Vdd is applied, a second electrode connected to a first electrode of a corresponding one of a plurality of switches tr9-tr16, and a gate electrode connected to the photo-sensor control line PCL.

Each of the photo-transistors tr1-tr8 is turned on according to the photo-sensor control signal applied to the gate electrode. Each of the photo-transistors tr1-tr8 generates a sensing signal (e.g., a sensing current) in response to the quantity of light L emitted by the sensing line SL and transfers the sensing signal to the switch unit 420.

Each of the capacitors C1-C8 is connected between a first electrode and a second electrode of a corresponding one of the photo-transistors tr1-tr8. The switch unit 420 includes a plurality of switches tr9-tr16. Each of the switches tr9-tr16 includes a first electrode connected to a second electrode of a corresponding one of the photo-transistors tr1-tr8, a second electrode connected to the sensing signal line SOL, and a gate electrode connected to a corresponding one of a plurality of switch driving lines Sp1-Sp8. Each of the switches tr9-tr16 is turned on according to a switch driving signal input to a corresponding one of the switch driving lines Sp1-Sp8, and a sensing signal transferred through a corresponding one of the photo-transistors tr1-tr8 is applied to the sensing signal line SOL.

The switch driver 430 generates a plurality of switch driving signals [Sp1]-[Sp8] according to the switch control signals CONT3 (see, e.g., FIG. 3) to control switching operations of the switches tr9-tr16.

Figure 3:
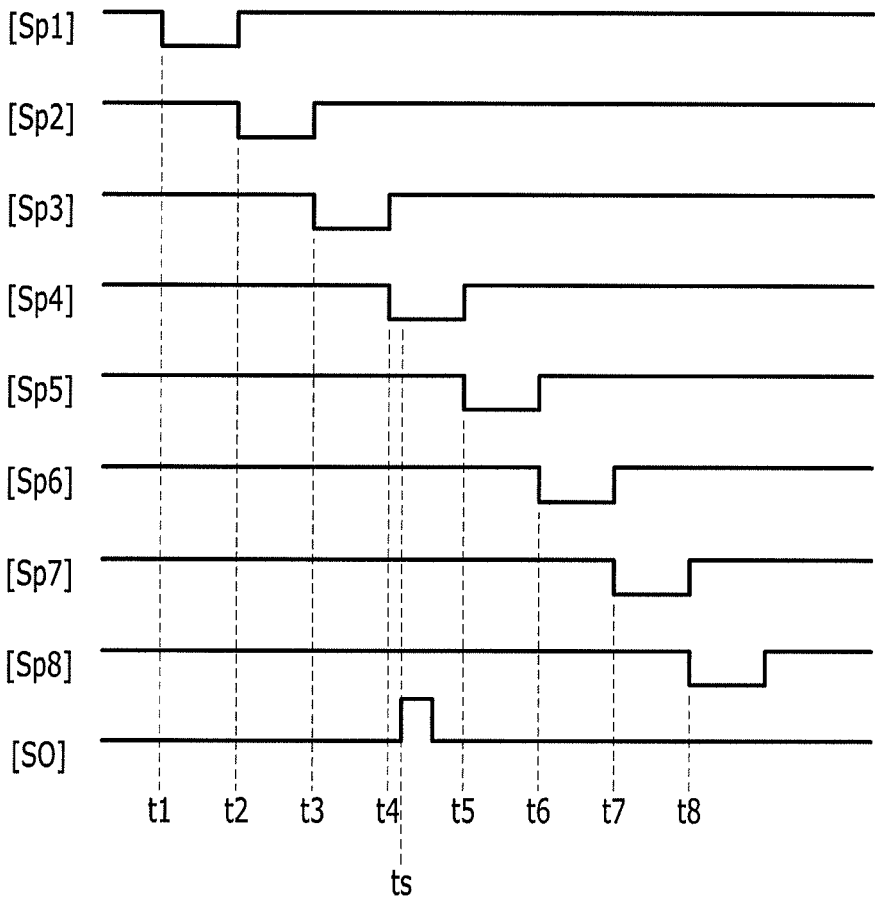
FIG. 3 illustrates an example of drive timings of a switch driver.

FIG. 3 illustrates an example of drive timings of the switch driver 430 in FIG. 2. The switch driver 430 controls the switching operation of the switches tr9-tr16 so that they are sequentially turned on by sequentially applying the switch driving signals [Sp1]-[Sp8] to the switch driving signal lines Sp1-Sp8 at a corresponding one of a plurality of time points t1-t8. When the switches tr9-tr16 are sequentially turned on, one of the photo-transistors tr1-tr8 that disposed to intersect the sensing line SL generates a sensing signal corresponding to the quantity of light L. The generated sensing signal is applied to the sensing signal line SOL. The sensing line may be displayed or may correspond to a light source outside of the display.

For example, when the sensing line SL and the photo-transistor t4 intersect each other, the photo-transistor t4 is turned on at a contact time point is between the time point t4 at which the switch driving signal Sp[4] is applied and the time point t5. Thus, the sensing signal is applied to the sensing signal line SOL.

In this case, based on the sensing signal and the switch driving time at which the switch driving signals Sp[1]-Sp[8] are applied, the signal controller 500 may identify one of the photo-transistors tr1-tr8 that intersects the sensing line SL and may recognize an intersection I (see, e.g., FIG. 4) corresponding to the identified photo-transistor. The signal controller 500 may generate a UI control signal based on movement of the recognized intersection I.

The switch unit 420 has been described to include 8 switches tr9-tr16. However, the switch unit 420 may have a different number of switches in another embodiment. Further, only one of the photo-transistors tr1-tr8 is described as intersecting the sensing line SL. However, multiple photo-transistors tr1-tr8 may intersect the sensing line SL.

Figure 4A:
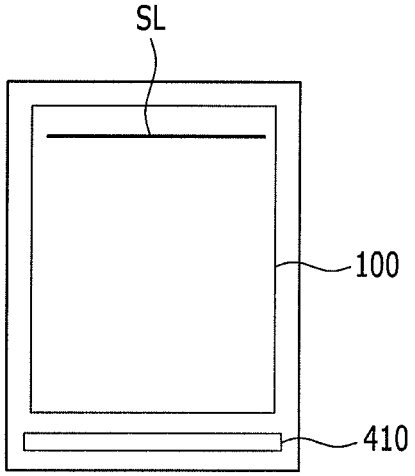
FIG. 4A illustrates an example of an unbent shape of the display device.
Figure 4B:
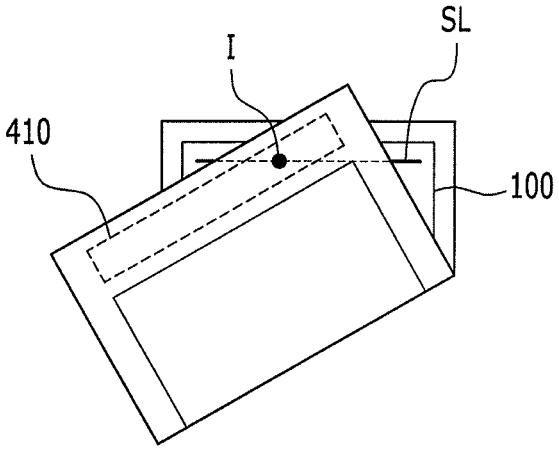
FIGS. 4B and 4C illustrate examples of bent shapes of the display device.
Figure 4C:
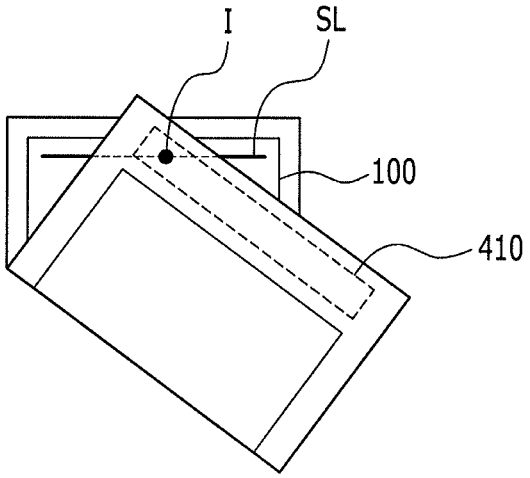
Figure 5A:
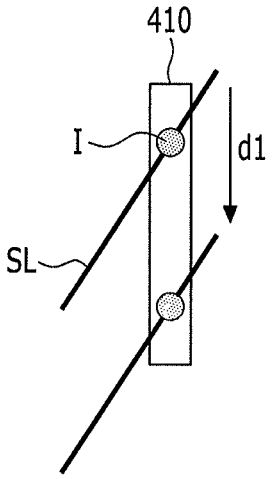
FIGS. 5A to 5C illustrate examples of the generation of a signal.
Figure 5B:
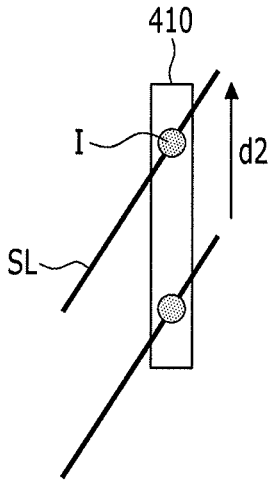
Figure 5C:
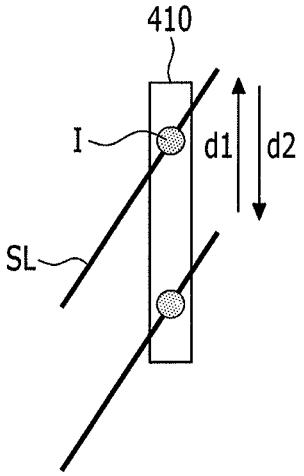

FIG. 4A illustrates an example of an unbent shape of the display device 1 in FIG. 1, and FIGS. 4B and 4C illustrate examples of bent shapes of the display device 1. Also, FIGS. 5A to 5C illustrate examples of how a signal may be generated base don the bent shapes of the display device 1 in FIG. 4B or FIG. 4C. Also, an embodiment of a method for generating a UI control signal will be described with reference to FIG. 1 and FIGS. 4A to 5C.

Referring to FIG. 4A, the display unit 100 may display the sensing line SL with a predetermined quantity of light. The sensing line SL may be, for example, a straight line, a slanted line, or another type of line or curve.

Referring to FIGS. 4A and 4B, the display unit 100 may be folded in left or right directions so that the sensing line SL and the photo-transistor unit 410 overlap each other. In this case, at least one of the photo-transistors tr1-tr8 generates a sensing signal corresponding to a quantity of light L of the sensing line SL. The signal controller 500 may identify a photo-transistor that generates the sensing signal based on the driving timing and the sensing signal, and may recognize an intersection I corresponding to the identified photo-transistor.

Referring to FIGS. 5A to 5C, when the display unit 100 moves in an opposite direction (e.g., right or left direction) to the direction in which the display unit has been being folded in the left or right direction, the intersection I moves in a first direction D1 or in a second direction D2. In this case, the signal controller 500 generates a UI control signal in response to the direction in which the intersection I moves.

For example, as shown in FIG. 5A, when the display unit 100 is folded in the right direction, the photo-transistor tr1 corresponds to the intersection I. As the display unit 100 is folded from the right to the left, the transistors tr1-tr8 sequentially correspond to the intersection I. In other words, the intersection I moves in the first direction d1 while sequentially corresponding to the transistors tr1-tr8. In this case, the signal controller 500 may generate a first UI control signal (e.g., call reception) in response to the intersection I moving in the first direction d1.

As shown in FIG. 5B, while the display unit 100 is folded in the left direction, the photo-transistor tr8 corresponds to the intersection I. As the display unit 100 is folded from the left to the right, the transistors tr8-tr1 sequentially correspond to the intersection I. In other words, the intersection I moves in the second direction d2 while sequentially corresponding to the transistors tr8-t1. In this case, the signal controller 500 may generate a second UI control signal (e.g., call completion) in response to the intersection I moving in the second direction d2.

As shown in FIG. 5C, while the display unit 100 is folded in the right direction, the photo-transistor tr1 corresponds to the intersection I. As the display unit 100 is folded from the right side to the left, the transistors tr1-tr8 sequentially correspond to the intersection I. Next, while the display unit 100 is folded from the left to the right, the transistors tr8-tr1 sequentially correspond to the intersection I. In other words, the intersection I moves in the first direction d1 while sequentially corresponding to the transistors tr1-tr8, and moves in the second direction d2 while sequentially corresponding to the transistors tr8-t1. In this case, the signal controller 500 may generate a third UI control signal (e.g., starting voice recording) in response to the intersection I, reciprocating one time from first direction d1 and second direction d2.

In addition, the signal controller 500 may generate a fourth UI control signal (e.g., ending voice recording) in response to the intersection I, reciprocating two times from the first direction d1 and the second direction d2.

Figure 6:
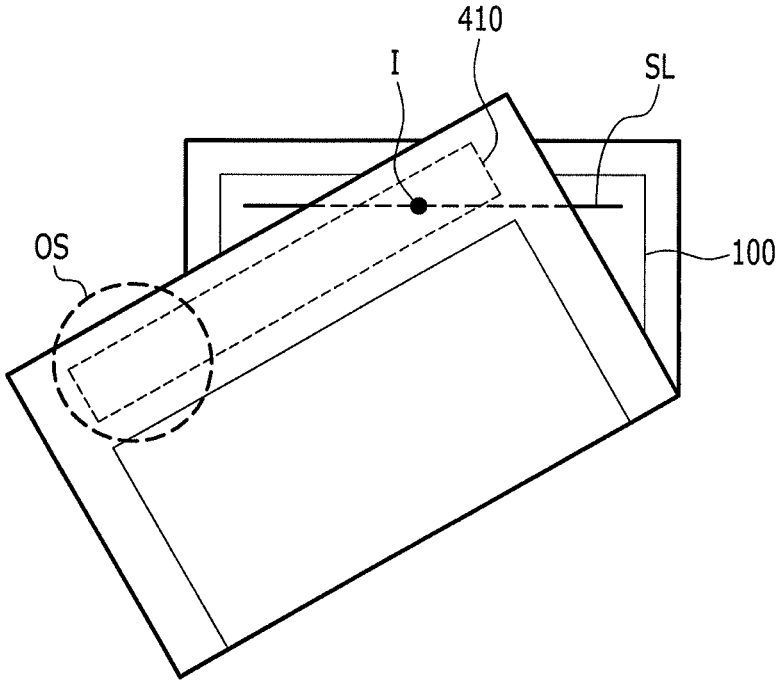
FIG. 6 illustrates an example of external light is applied to a photo-transistor.
Figure 7:
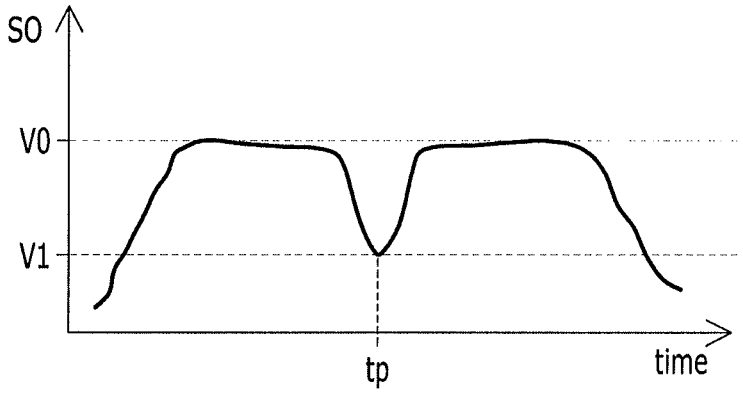
FIG. 7 illustrates an example of a sensing signal for dividing light sources.

FIG. 6 illustrates an example of how external light may be applied to a photo-transistor. FIG. 7 illustrates an embodiment of a sensing signal for dividing light sources.

Referring to FIG. 6, while the display unit 100 is folded in the left direction, the photo-transistor tr8 corresponds to the intersection I, but an area OS of the photo-transistor unit 410 is exposed to external light, e.g., sunlight or electric light. Accordingly, the photo-transistor in the area OS may generate a sensing signal in response to the external light, which is a wrong UI control signal.

Therefore, as shown in FIG. 7, the signal controller 500 generates image data DAT such that a photo-transistor corresponding to the intersection I generates a sensing signal of a first level V0 after or before a predetermined time point tp. The signal controller 500 generates a sensing signal of a second level V1 that is lower than the first level V0 at the predetermined time point tp. When the sensing signal of the second level V1 is detected at the predetermined time point tp, the signal controller 500 recognizes that the sensing signal is generated from the sensing line SL, rather than from an external light source. Thus, the signal controller 500 generates the image data DAT so that the sensing line SL flickers at the predetermined time point tp, in order to recognize the sensing signal generated by the sensing signal SL.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods herein.

The signal controller may be implemented in logic which, for example, may include hardware, software, or both. When implemented at least partially in hardware, the signal controller may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the signal controller may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the invention as set forth in the following claims.

What is claimed is:

1. A display device, comprising:

a flexible display including a sensing line;

a sensor to generate a sensing signal corresponding to a quantity of light of the sensing line;

a signal controller to detect an intersection of the sensing line and the sensor when the flexible display is folded along a fold line and to generate a control signal corresponding to movement of the intersection, a plurality of switches; and a switch driver to control the switches, wherein each of the photo-transistors includes a first electrode to receive a driving voltage, a second electrode connected to a first electrode of one of the switches, and a gate electrode to receive the photo-sensor control signal, wherein the sensing line and the fold line are at different locations, wherein the sensor includes a plurality of photo-transistors, and wherein the signal controller is to detect the intersection of the sensing line and at least one of the photo-transistors while the display is folded in a first direction.

2. The display device as claimed in claim 1, wherein the signal controller is to generate a first control signal based on movement of the intersection in a first direction.

3. The display device as claimed in claim 2, wherein the signal controller is to generate a second control signal based on movement of the intersection in a second direction opposite to the first direction.

4. The display device as claimed in claim 3, wherein the signal controller is to generate a third control signal based on reciprocal movement of the intersection in the first and second directions at least one time.

5. The display device as claimed in claim 4, wherein the signal controller is to generate a fourth control signal based on reciprocal movement of the intersection in the first and second directions at least two times.

6. The display device as claimed in claim 1, wherein:

each of the switches includes a first electrode connected to a second electrode of one of the photo-transistors, a second electrode connected to a sensing signal line, and a gate electrode connected to one of a plurality of switch driving lines, each of the switches is to be turned on by a switch driving signal applied from the switch driving line.

7. The display device as claimed in claim 6, wherein:

the switch driver is to sequentially apply the switch driving signal to the switches, and the switch driver is to sequentially apply a switch driving signal to a gate electrode of each of the switches, the signal controller is to detect the intersection based on the sensing signal and a switch driving time when the switch driving signal is applied.

8. The display device as claimed in claim 7, wherein:

the display is to display the sensing line;

the sensor is to generate a first sensing signal of a first level at a time point other than a predetermined time point;

the sensor is to generate a second sensing signal of a second level lower than the first level at the predetermined point; and the signal controller is to recognize that the sensing signal is generated from the sensing line when the second sensing signal of the second level is generated at the predetermined time point.

9. An apparatus, comprising:

a flexible display to display a line;

a sensor to generate a first signal when light is detected from the line;

logic to generate a second signal based on the first signal, wherein the sensor is to generate the first signal when the flexible display is folded along a fold line to cause the line to intersect the sensor, a plurality of switches; and a switch driver to control the switches, wherein each of the photo-transistors includes a first electrode to receive a driving voltage, a second electrode connected to a first electrode of one of the switches, and a gate electrode to receive the photo-sensor control signal, wherein the line and the fold line are at different locations, wherein the sensor includes a plurality of photo-transistors, and wherein the signal controller is to detect the intersection of the sensing line and at least one of the photo-transistors while the display is folded in a first direction.

10. The apparatus as claimed in claim 9, wherein:

the line is adjacent a first side of the display, and the sensor is adjacent a second side of the flexible display.

11. The apparatus as claimed in claim 10, wherein the first and second sides are opposing sides of the flexible display.

12. The apparatus as claimed in claim 9, wherein the logic is to generate a first control signal based on movement of the intersection.

13. The apparatus as claimed in claim 12, wherein the first control signal corresponds to a call function.

14. The apparatus as claimed in claim 9, wherein the logic is to generate a first control signal based on movement of the intersection in a first direction.

15. The apparatus as claimed in claim 14, wherein the logic is to generate a second control signal based on movement of the intersection in a second direction opposite to the first direction.

* * * * *